US007043768B2

(12) United States Patent
Gogarty

(10) Patent No.: US 7,043,768 B2
(45) Date of Patent: May 16, 2006

(54) THERMAL GEL FILLED GLOVE

(76) Inventor: Kayla Gogarty, 1285 Cortez Ave., Burlingame, CA (US) 94010

( * ) Notice: Subject to any disclaimer, the term of this patent is extended or adjusted under 35 U.S.C. 154(b) by 0 days.

(21) Appl. No.: 10/314,654

(22) Filed: Dec. 9, 2002

(65) Prior Publication Data

US 2004/0107475 A1 Jun. 10, 2004

(51) Int. Cl.
*A41D 19/00* (2006.01)

(52) U.S. Cl. ..... 2/161.1; 607/111

(58) Field of Classification Search ..... 2/160, 2/161.1, 161.6, 161.7, 167, 161.2; 602/2, 602/14, 62, 64, 75; 607/111, 108, 114
See application file for complete search history.

(56) References Cited

U.S. PATENT DOCUMENTS 3,874,000 A * 4/1975 Altman ..... 2/158
4,535,482 A * 8/1985 Spector et al. ..... 2/160
4,976,262 A 12/1990 Palmacci
5,035,003 A * 7/1991 Rinehart ..... 2/159
5,050,596 A 9/1991 Walasek et al.
5,483,697 A * 1/1996 Fuchs ..... 2/161.7
5,632,045 A * 5/1997 Chase et al. ..... 2/161.6
5,867,829 A * 2/1999 Hegoas et al. ..... 2/159
5,867,832 A * 2/1999 Liu ..... 2/161.7
5,935,157 A * 8/1999 Harmon ..... 607/111
5,984,951 A 11/1999 Weiss et al.
6,098,200 A * 8/2000 Minkow et al. ..... 2/161.1
6,141,801 A * 11/2000 Helenick ..... 2/159
6,216,276 B1 * 4/2001 Eibert ..... 2/161.2
2002/0058976 A1 * 5/2002 Lee ..... 607/110
2003/0109910 A1 * 6/2003 Lachenbruch et al. ..... 607/108

OTHER PUBLICATIONS

Printout of Web Page for www.lemitt.com (Printed Jun. 28, 2002); Date of Publication Unknown.

* cited by examiner

*Primary Examiner*—Katherine M. Moran
(74) *Attorney, Agent, or Firm*—Vierra Magen Marcus & DeNiro LLP

(57) ABSTRACT

A thermal treatment device formed to the shape of the human hand. The device may include an inner layer formed to surround the hand, and having an opening in one end to allow the hand to be inserted therein, and an outer layer formed to surround the inner layer and forming at least one pocket between the inner layer and the outer layer. A thermal gel occupies the pocket, the thermal gel retaining a temperature to which it is subjected and transmitting said temperature via the inner layer.

15 Claims, 3 Drawing Sheets

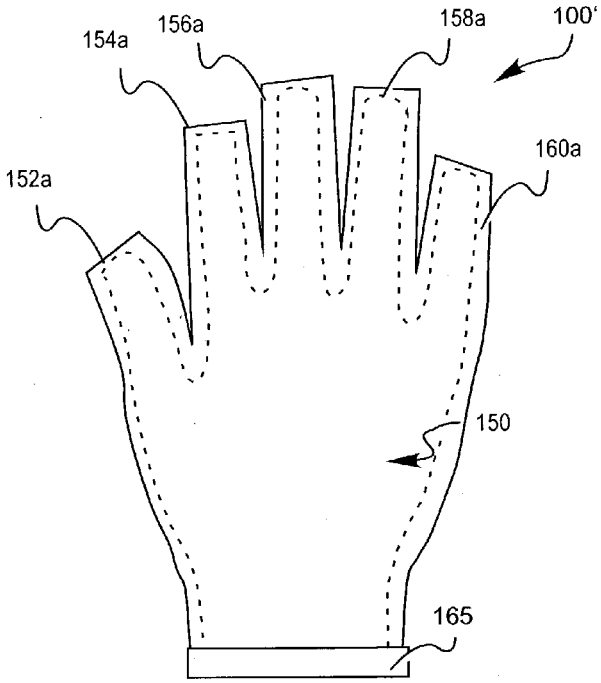
Fig. 4
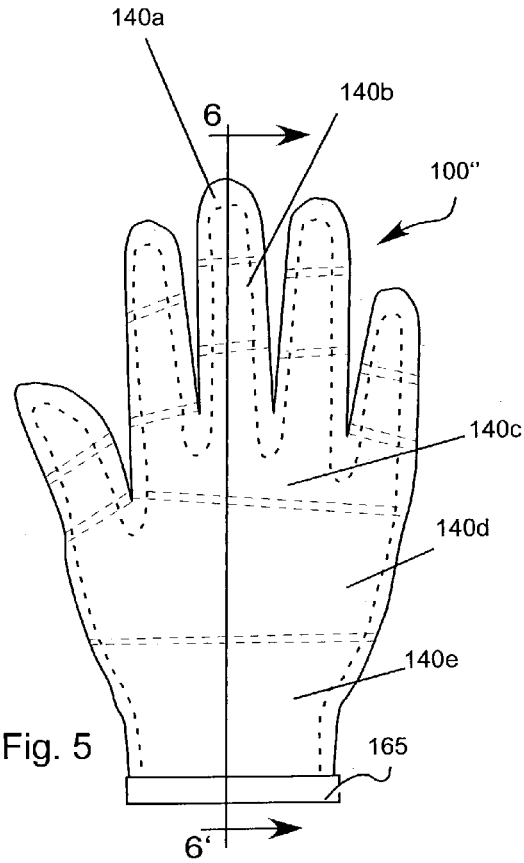
Fig. 5
Fig. 6
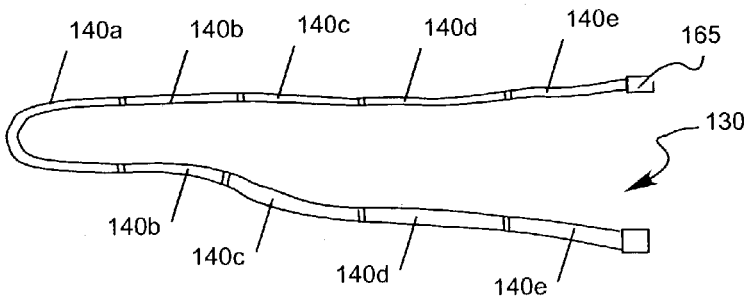

THERMAL GEL FILLED GLOVE

BACKGROUND

1. Field of the Invention

The present invention is directed to the application of thermal treatment to the human body.

2. Description of the Related Art

Various devices have been developed to apply thermal treatment to the human body. Perhaps the most basic and well known of such devices are the ice bag, ice pack and the hot water bottle. Although somewhat effective, people have sought to develop treatment devices specifically configured to different parts of the body, particularly those parts of the body which do not lend themselves to easy application of thermal treatment.

One such part of the human body is the hand. For example, using an ice pack on the hand to apply cold treatment requires that the hand be kept still and the pack balanced on the hand, or that one hold the pack in place with one's other hand. As a result, people have attempted to develop devices for holding icepacks on the hand, or other hand-specific treatment devices. One example is disclosed in U.S. Pat. No. 6,141,801 which discloses a thermal glove having a space for insertion of a gel pack which may be heated or cooled to provide a therapeutic effect. In the '801 patent, the glove is of a five digit design having the gel pack attached to or incorporated within a back hand portion of the body.

The gel pack includes a sealed bladder constructed of flexible, durable material resistant to heat and rupture. Contained within the gel pack is a thermal gel adapted for repeated heating and cooling, such as by microwave exposure or refrigeration. The gel pack functions as a non-chemical, non-electrical and non-fuel burning heating element which retains and transmits heat energy or cold to the hand of a wearer and is repeatedly rechargeable.

However, the apparatus disclosed in the '801 patent suffers from the fact that it applies thermal treatment to a limited area of the hand, it must use separate thermal packs, and it does not cover the entire hand.

Another treatment device is shown in U.S. Pat. No. 5,050,596 which discloses a reusable and microwavable hot or cold therapy mitt. The mitt is primarily designed for use in heated therapy applications, but the written description discloses that the mitt can be used for cold therapy applications as well. While applying the thermal therapy to more area of the hand than the apparatus of the '801 patent, it nevertheless does not allow the wearer to make use of the hand while it is being worn, nor does it apply thermal treatment to areas such as those between fingers or between the fingers and the thumb.

SUMMARY

The present invention, roughly described, pertains to thermally treating part of a body, specifically a human hand. In one aspect, the invention comprises a thermal glove. The glove includes an inner layer defining finger pockets, a thumb pocket and a metacarpal pocket. The glove further includes an outer layer having a shape corresponding to the inner glove layer and being larger than the inner glove layer and disposed about the inner glove layer. In addition, a thermally retentive gel disposed about the inner layer between the inner layer and the outer layer.

In one aspect, the inner glove layer engages substantially the entire surface of the human hand including the fingers, thereby allowing the thermally retentive gel to communicate with the surface of the hand and fingers.

In a further aspect, the invention comprises a thermal treatment device formed to the shape of the human hand. The device may include an inner layer formed to surround the hand, and having an opening in one end to allow the hand to be inserted therein, and an outer layer formed to surround the inner layer and forming at least one pocket between the inner layer and the outer layer. Additionally, a thermal gel occupies the pocket, the thermal gel retaining a temperature to which it is subjected and transmitting said temperature via the inner layer.

The device provides thermal treatment to all portions of the hand and allows the user to continue to use the hand while treatment is applied. Thermal treatment is more uniform than with prior art products, and provides comfort to the wearer during its application.

These and other advantages of the present invention will appear more clearly from the following description in which the preferred embodiment of the invention has been set forth in conjunction with the drawings.

BRIEF DESCRIPTION OF THE DRAWINGS

The invention will be described with respect to the particular embodiments thereof. Other objects, features, and advantages of the invention will become apparent with reference to the specification and drawings in which:

FIG. 4 depicts a plan view of a second embodiment of the glove of the present invention.

FIG. 5 depicts a plan view of a third embodiment of the glove of the present invention.

FIG. 6 depicts a cross sectional view along line 6–6' in FIG. 5.

WRITTEN DESCRIPTION

Figure 1:
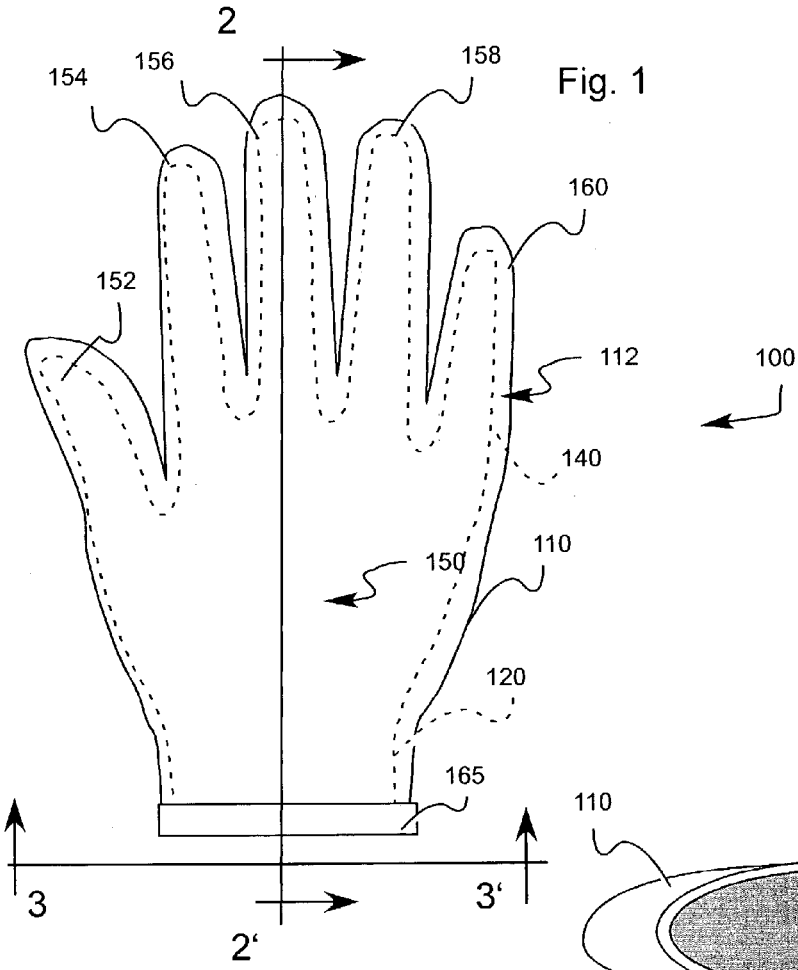
FIG. 1 depicts a plan view of a first embodiment of the glove of the present invention.
Figure 3:
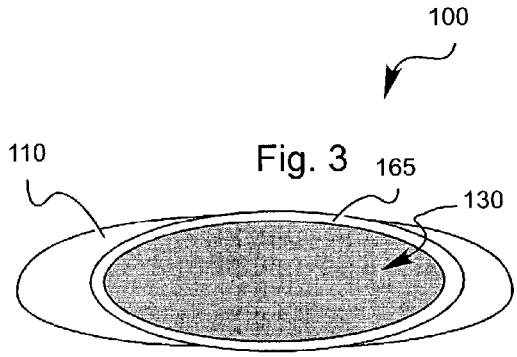
FIG. 3 depicts an end view along line 3–3' in FIG. 1.
Figure 2:
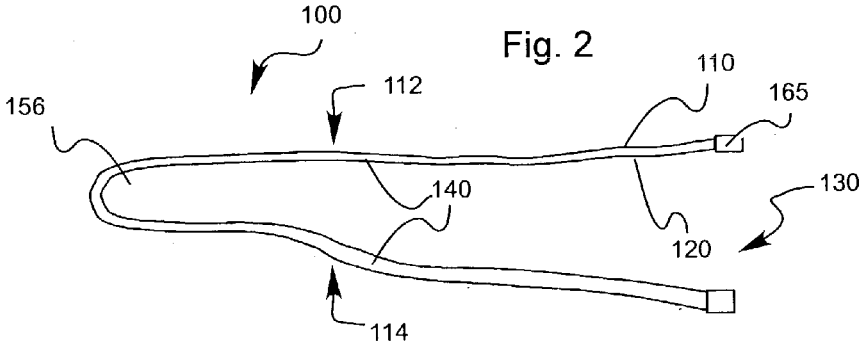
FIG. 2 depicts a cross-sectional view along line 2–2' in FIG. 1.

FIG. 1 shows a first plan view of a first embodiment of the thermal glove 100 of the present invention. FIG. 2 shows a cross-sectional view along line 2–2' in FIG. 1, and FIG. 3 is an end view along line 3–3' of the thermal glove 100. As will be understood from a review of this written description, many alternatives of the thermal glove are possible and are within the scope of the invention as defined herein.

As shown in FIGS. 1–3, thermal glove 100 is formed into the shape of a human hand and includes an outer layer 110 and an inner layer 120. The outer layer 110 is formed to be larger than the inner layer 120 to form a pocket 140 between the inner layer and the outer layer. A seal 165 is positioned about the opening 130, which ensures pocket 140 is a sealed region. Not shown is a human hand inserted into the glove. It will be readily understood that the hand will be positioned in the glove by entering an opening 130, shown in FIGS. 2 and 3, and positioning the hand adjacent to the inner layer 120 of the glove.

Both the inner layer 120 and outer layer 110 have formed therein a metacarpal region 150, a thumb region 152, and finger regions 154, 156, 158, and 160. Each said metacarpal region, thumb region and finger regions are designed to accept corresponding portions of the human hand. As shown in FIGS. 2 and 3, the glove has an upper surface 112, generally covering the back of a hand, and a lower surface 114, generally covering the inside of a hand.

A thermal gel is provided in the pocket 140. The gel is of a type commonly known in the art to retain a heating effect or cooling effect applied thereto. In either case, the gel chosen for application between the inner layer 120 and outer layer 110 should remain pliable following the thermal treatment applied thereto. In one embodiment, a thermal gel such as that found in "Reusable Gel Packs" and Jack Frost® Hot and Cold Packs, commercially available from Allegiance Corporation, McGaw Park, Ill. may be used. This commercially available gel pack includes a gel which retains a cold or hot temperature, and remains pliable after being subjected to freezing temperatures or microwave radiation in a conventional microwave oven for a sufficient period of time.

Figure 7:
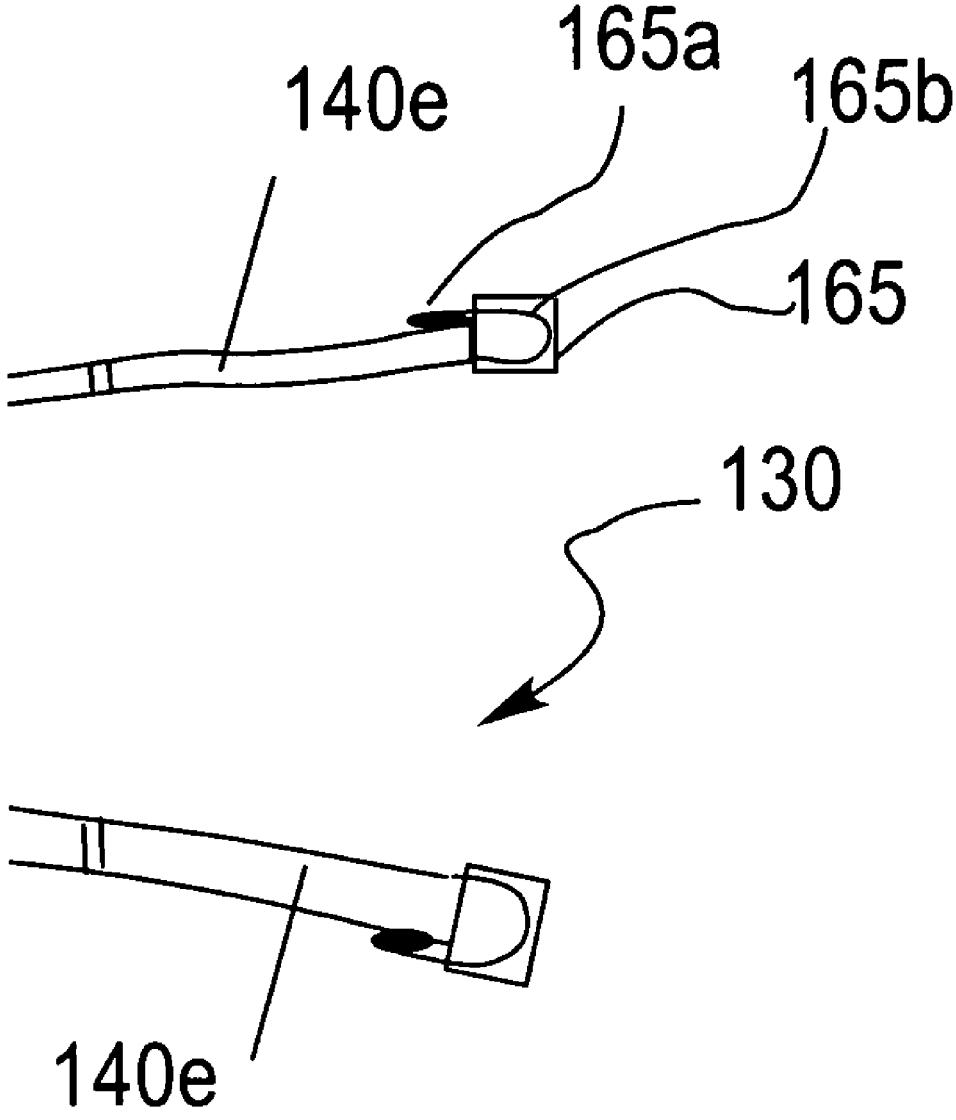
FIG. 7 is a partial, cut-away of the glove opening.

In one exemplary construction, the outer later is formed of vinyl and the inner layer formed of latex. For example, the inner layer may comprise a Playtex® brand latex glove surrounded by a vinyl surgical glove. The latex glove may be placed within the vinyl glove and the contents of approximately one gel icepack (approximately 6–6.5 oz) are inserted between the inner and outer gloves. Next, a glue gun may be used to secure the folded bottom 165*b* of the latex glove about the vinyl glove and form seal 165*a*. Seal 165*a* may also be formed by providing a separate sealing ring, or other secure sealing method or device, about the ends of the inner and outer gloves. This is illustrated in FIG. 7.

In an alternative embodiment, various sizes of commercially available gloves may be used in the construction to provide therapeutic gloves for various size hands. In another alternative embodiment, gloves of different materials and constructions may be used. For example, the inner and outer layers may be custom molded to provide an equidistant layer gap between the inner and outer layer at all points in the glove structure. Moreover, various amounts of gel may be used in accordance with the invention. One could use more gel if greater temperature retention were desired, recognizing that an increased amount of gel would result in the flexibleness and tactileness of the glove feeling more restricted to the user.

In yet another alternative embodiment, the inner and outer layers may be molded from a common material, or different materials. It is advantageous that the inner layer 120 be molded in a fashion similar to the commonly known latex surgical glove such that the glove has no seams at that will interfere with thermal treatment to the hand in the glove.

In an alternative embodiment, the outer layer 110 may be formed of two layers having a shape similar to that shown in FIG. 1 may be fashioned of a flat sheet of the same material, or sheets of different material, and bonded at the outer edge thereof to secure the layers together. This embodiment allows one type of material to be used on the lower side 114 of the glove and a different material on the upper side 112 of the glove on the outer layer. Various materials may be used for the inner layer including hypoallergenic materials, rubber, and latex. Any material which is thermally conductive and which will not irritate the hand, as well as a material which is non-porous enough to retain the gel within the pocket 140 between the inner and outer layer, is suitable for use in the present invention.

In yet another embodiment, the outer layer may be comprised of a thermally insulating material—such as leather, formed insulated rubber or the like—on both the upper and lower sides, or just the upper side, to improve thermal retention in the gel. The lower surface 114 may be made of a tactile material, or a tactile material may overlie the insulating material.

In a unique aspect, the pocket 140 is designed to carry the gel around the entire hand. Previously known designs include selected regions where the gel is applied to the hand, or are limited in their ability to apply gel to the hand. For example, the '801 patent applies thermal treatment to a limited area of the hand, while the '596 patent could not apply effective thermal treatment between the fingers. In the present invention, were one to require treatment between the fingers, the thermal glove of the present invention can apply hot or cold treatment to the afflicted area. The glove 100 can apply thermal treatment to any part of the hand with equal effectiveness.

Yet another alternative embodiment is shown in FIG. 4 wherein the tips of the fingers and thumb regions have been removed. This allows the wearer to use the tips of the fingers while still applying thermal treatment to the remainder of the hand. Formation of the embodiment shown in FIG. 4 may be performed as noted above, but prior to inserting the gel, one may remove the tips of the finger and thumb regions, and heat or glue seal the tips to form regions 152*a*, 154*a*, 156*a*, 158*a*, and 160*a*. Alternatively, the glove may be preformed or molded into the configuration shown in FIG. 4.

FIGS. 5 and 6 show yet another embodiment of the present invention wherein the pocket 140 is divided into sub-pockets 140*a*–140*e* in order to retain the gel in geographically distinct regions about the hand. The embodiment of FIG. 5 prevents unequal distributions of the gel as a result of movement of the gel through the interior of pocket 140. Each sub-pocket may be formed by heat or glue sealing the upper layer to the lower layer in any number of shapes and patterns to retain numerous pocket shapes within the region. The sub-pockets shown in FIGS. 5 and 6 are exemplary of the type of sub-pockets which may be formed in the glove. It will be readily understood that any number of pockets may be formed in the glove, as long as sufficient volume for therapeutic application of thermal gel remains. Moreover, it should be understood that any shape of pocket may be used, and that the shape of the sub-pockets will have a direct effect on the therapeutic effect of the thermal gel. For example, the sub-pockets need not run along the width of the hand and fingers, but may also run longitudinally along the length of the hand.

The foregoing detailed description of the invention has been presented for purposes of illustration and description. It is not intended to be exhaustive or to limit the invention to the precise form disclosed. Many modifications and variations are possible in light of the above teaching. The described embodiments were chosen in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A thermal glove comprising:

an inner layer defining finger regions, a thumb region and a metacarpal region;

an outer layer having a shape corresponding to the inner glove layer and being larger than the inner glove layer and disposed about the inner glove layer; and a thermally retentive gel disposed about the inner layer between the inner layer and the outer layer, the inner glove layer and outer glove layer including a plurality of pockets formed between the inner layer and the outer layer, each pocket including a quantity of said gel;

wherein the inner glove layer engages substantially the entire surface of the back and palm of a human hand, including encircling the fingers, at least one of the plurality of pockets being associated with each finger region, the thumb region and the metacarpal region, thereby allowing the thermally retentive gel to communicate with the inner glove layer in contact with the hand and fingers in said finger regions, a thumb regions and a metacarpal region.

2. The thermal glove of claim 1 wherein the glove includes an upper surface covering substantially the back of the hand and a lower surface covering the interior of the hand, and wherein the inner glove layer is formed of a tactile material which is different from the upper surface.

3. The thermal glove of claim 1 wherein the inner glove is formed of latex.

4. The thermal glove of claim 1 wherein the outer glove layer is formed of vinyl.

5. The thermal glove of claim 1 wherein the finger pockets and thumb pocket each include an opening allowing a portion of a finger or thumb, respectively, to extend out of the glove when a hand is inserted into the glove.

6. A glove formed of a pliable material, comprising:

a flexible glove body, the glove body defining finger regions, a thumb region and a metacarpal region, the body including:

an inner layer contacting the hand of a wearer of the glove and an outer layer surrounding the inner layer to create a plurality of pockets formed between the inner layer and the outer layer fully surrounding the inner layer, at least one of the plurality of pockets being associated with each finger region, the thumb region and the metacarpal region; and a pliable thermal gel filling each of the plurality of pockets;

wherein the inner layer engages substantially the entire surface of the human hand including encircling the fingers thereby allowing the thermally retentive gel said plurality of pockets to communicate with the surface of the hand and fingers.

7. The glove of claim 6 wherein the glove includes an upper surface covering substantially the back of the hand and a lower surface covering the interior of the hand, and wherein the interior surface is formed of a tactile material which is different from the upper surface.

8. The thermal glove of claim 6 wherein the inner layer is formed of latex.

9. The thermal glove of claim 8 wherein the outer layer is formed of vinyl.

10. The thermal glove of claim 6 wherein the finger pockets and thumb pocket each include an opening allowing a portion of a finger or thumb, respectively, to extend out of the glove when a hand is inserted into the glove.

11. A thermal treatment device formed to the shape of the human hand, the device including:

an inner layer formed to surround the hand defining finger regions, a thumb region and a metacarpal region, the finger regions encircling at least a portion of each of the fingers, and having an opening in one end to allow the hand to be inserted therein;

an outer layer formed to surround the inner layer and forming a plurality of pockets between the inner layer and the outer layer, at least one of the plurality of pockets being associated with each finger region, the thumb region and the metacarpal region; and a thermal gel deposited in each of the plurality of pockets in contact with at least the inner layer, the thermal gel retaining a temperature to which it is subjected and transmitting said temperature via the inner layer, the inner layer thereby engaging substantially the entire surface of the human hand including encircling the fingers thereby allowing the thermally retentive gel in said plurality of pockets to communicate with the surface of the hand and fingers.

12. The thermal treatment device of claim 11 wherein the inner layer is latex.

13. The thermal treatment of claim 12, wherein the outer layer is vinyl.

14. The thermal treatment device of claim 13 further including a seal provided between the inner and outer layer.

15. The thermal treatment device of claim 14 wherein the seal comprises a folded portion of the latex glove sealed to the vinyl glove.

* * * * *